US006183319B1

(12) United States Patent
Ishigaki

(10) Patent No.: US 6,183,319 B1
(45) Date of Patent: Feb. 6, 2001

(54) CLOSURE PREVENTIVE DEVICE FOR WATER JET PROPULSION TYPE OUTBOARD MOTOR

(75) Inventor: Eiichi Ishigaki, Kagawa-ken (JP)

(73) Assignee: Ishigaki Company Limited, Tokyo (JP)

( * ) Notice: Under 35 U.S.C. 154(b), the term of this patent shall be extended for 0 days.

(21) Appl. No.: 09/319,675

(22) PCT Filed: Oct. 9, 1998

(86) PCT No.: PCT/JP98/04562

§ 371 Date: Jun. 9, 1999

§ 102(e) Date: Jun. 9, 1999

(87) PCT Pub. No.: WO99/19209

PCT Pub. Date: Apr. 22, 1999

(30) Foreign Application Priority Data

Oct. 9, 1997 (JP) ..... 9-277077
Oct. 9, 1997 (JP) ..... 9-277078
Apr. 1, 1998 (JP) ..... 10-87832

(51) Int. Cl.[7] ..... B63H 11/01
(52) U.S. Cl. ..... 440/46
(58) Field of Search ..... 440/38, 46, 47; 60/221, 222

(56) References Cited

U.S. PATENT DOCUMENTS 3,343,368 9/1967 Castoldi .
3,478,712 * 11/1969 Fox ..... 440/46
5,989,083 * 11/1999 Ishigaki et al. ..... 440/46

FOREIGN PATENT DOCUMENTS 162194 4/1989 (JP) .
1141200 9/1989 (JP) .
7132884 5/1995 (JP) .
7158716 6/1995 (JP) .
7323889 12/1995 (JP) .
826190 1/1996 (JP) .

* cited by examiner

*Primary Examiner*—Ed Swinehart
(74) *Attorney, Agent, or Firm*—Howard & Howard

(57) ABSTRACT

A blockage preventing apparatus used for a water jet propulsion unit (2) is provided with a screen (6), springs (22), an engagement protrusion (21) and an engagement end portion (20*a*). The screen (6) is rotatably supported with respect to the front end of a suction port (7) and movable between a closed position at which the screen covers the suction port (7) and an open position shifted downward from the suction port (7). The springs (22) urge the screen (6) to the closed position through a working shaft (17). The engagement protrusion (21) is provided at the working shaft (17) and moves together with the screen (6). The engagement end portion (20*a*) moves from the first position and moves beyond the second position. When the engagement end portion (20*a*) moves from the first position to the second position, the engagement end portion (20*a*) is engaged with and presses the engagement protrusion (21) to thereby move the screen (6) from the closed position to the open position. When the engagement end portion (20*a*) moves beyond the second position, the engagement protrusion (21) is disengaged from the engagement end portion (20*a*) and the screen (6) is momentarily returned from the open position to the closed position by the springs (22).

14 Claims, 7 Drawing Sheets

CLOSURE PREVENTIVE DEVICE FOR WATER JET PROPULSION TYPE OUTBOARD MOTOR

TECHNICAL FIELD

The present invention relates to a blockage preventing apparatus for a water jet propulsion unit used in a hull.

BACKGROUND ART

Since a water jet propulsion unit for a hull draws and injects water in the neighborhood of the water surface, it is blocked in a short time when pulling floating matter or pieces. Due to this, a screen is provided at an intake to prevent large floating pieces from being drawn into a suction casing.

However, floating matter or pieces cling to the screen in the water where many other or pieces are floating so that cavitations and the like occur in the water jet propulsion unit, thereby reducing propulsion force. There are some cases where a vessel cannot continue running when the floating matter clinging to the screen increases. In particular, when the screen is of a fixed type navigating the vessel becomes impossible in quite a short time.

To eliminate the floating matter or pieces clinging to the fixed screen, there has been proposed an apparatus in which a movable screen is combined with a fixed screen as disclosed in, for example, Japanese Patent Application Publication No. 54-18475 or Japanese Patent Application Laid-Open No. 6-32288.

Even with a movable screen, once floating matter strongly clings to the screen, it is difficult to remove it and the navigation of the vessel might become impossible.

Furthermore, when floating matter or pieces pass through the screen, are drawn into the suction casing and deposited, the water jet propulsion unit is blocked. To remove the deposited matter or pieces, it is necessary to provide a hand hole in the water jet propulsion unit and to remove the deposited matters manually while the vessel is stopped.

DISCLOSURE OF THE INVENTION

The present invention has been made in consideration of the conventional problems stated above. It is therefore an object of the present invention to provide a blockage preventing apparatus capable of ensuring the elimination of floating matter strongly clinging to a screen.

It is another object of the present invention to provide blockage preventing apparatus capable of preventing dust from passing through the screen and being deposited in a water jet propulsion unit.

To attain the above object, a first aspect of the present invention is a blockage preventing apparatus used for a water jet propulsion unit provided with a casing member including a lower opening at a front end, a lateral opening at a rear end and an internal space between the lower opening and the lateral opening, and vanes arranged within the internal space and rotated for drawing water from the lower opening to inject the water from the lateral opening, the blockage preventing apparatus comprising:

a screen rotatably supported with respect to a front end edge of the lower opening and moving between a closed position at which the screen covers the lower opening and an open position shifted downward from the lower opening;

an urging member urging the screen to the closed position;

a first engagement portion moving together with the screen; and a second engagement portion moving from a first position beyond a second position, wherein when the second engagement portion moves from the first position to the second position, the second engagement is engaged with and presses the first engagement portion to move the screen from the closed position to the open position, and when the second engagement portion moves beyond the second position, the first engagement portion is disengaged from the second engagement portion and the screen is returned from the open position back to the closed position by the urging member.

The blockage preventing apparatus may further comprise an open/close driving machine for moving the second engagement portion, and the second engagement portion may be set such that a movement region of the second engagement portion from the first position to the second position overlaps a movement region of the first engagement portion and the movement region of the second engagement portion beyond the second position is out of the movement region of the first engagement portion.

The open/close driving machine may include a piston moved forward and backward by oil pressure, and the second engagement portion may be provided at the piston.

When the vessel sails in a location where much floating matter, such as floating pieces or materials exist, there is a high possibility that the floating matter may cling to the screen. For this reason, the second engagement portion is appropriately moved from the first position toward the second position. Thereby, the second engagement portion is engaged with and presses the first engagement portion and the screen is moved from the closed position to the open position against the urging force of the urging member, thereby opening the lower opening. At this time, the screen opens. When the second engagement portion moves beyond the second position, the second engagement portion is disengaged from the first engagement portion so that the screen is momentarily moved to the closed position by the urging force of the urging member. When the second engagement portion is moved to the second position again after returned to the first position, the screen opens the lower opening again. In this way, the screen slowly opens the lower opening and then to quickly moves to the closed position.

Therefore, while the screen slowly moves to the open position, the floating matter, such as floating pieces or materials, clinging to the screen is driven out by water flow to thereby clean the screen. Since the screen quickly returns from the open position to the closed position, it is difficult for floating matter to flow into the suction port while the screen is moving to the open position. In addition, appropriate vibration and impact are applied to the screen by the quick return of the screen from the closed position to the open position. Thus, the effect of removing the floating matter clinging to the screen increases, thereby cleaning the screen more effectively. It is, therefore, possible to ensure eliminating the floating matter strongly clinging to the screen. Additionally, by repeating the opening/closing operation a plurality of times, the effect of cleaning the screen further improves.

A second aspect of the present invention is the blockage preventing apparatus according to the first aspect, further comprising open/close controlling means for intermittently actuating the open/close driving machine at predetermined time intervals.

The intervals at which the open/close control means actuate the open/close driving machine may be set according to the quantity of floating matter. The appropriate setting range is, preferably, not less than 10 seconds and not more than 120 seconds.

With the above constitution, since the screen is opened and closed at predetermined time intervals, the screen is cleaned before the quantity of the floating matters clinging to the screen becomes excessive. This facilitates removing the floating matter from the screen and enhances the effect of cleaning the screen.

A third aspect of the present invention is a blockage preventing apparatus according to the first aspect, further comprising:

rotating speed detecting means for detecting a rotating speed of the vane;

hull speed detecting means for detecting a speed of a hull; and control means for estimating a design speed of the hull corresponding to the detected rotating speed of the vane and for actuating the open/close driving machine in accordance with a reduction rate of the hull speed with respect to the design speed.

With the above constitution, when the quantity of floating matter clinging to the screen increases and the hull speed is reduced, then the hydraulic cylinder is actuated in accordance with the reduction rate. It is, therefore, possible to clean the screen before the quantity of floating matter clinging to the screen becomes excessive. This facilitates removing the floating matter from the screen and thereby enhances the cleaning effect for the screen.

The fourth aspect of the present invention is a blockage preventing apparatus according to the first aspect, further comprising:

pressure detecting means for detecting an internal pressure of an internal space of the casing member; and control means for actuating the open/close driving machine in accordance with a reduction in the internal pressure.

With the above constitution, when the quantity of floating matter clinging to the screen increases and the internal pressure of the casing member decreases, the open/close driving machine is actuated in accordance with the reduction of the pressure. It is, therefore, possible to clean the screen before the quantity of floating matter clinging to the screen becomes excessive. This facilitates removing the floating matter from the screen and enhances cleaning the screen.

The fifth aspect of the present invention is a blockage preventing apparatus used for a water jet propulsion unit provided with a casing member including a lower opening at a front end, a lateral opening at a rear end and an internal space between the lower opening and the lateral opening and with vanes arranged within the internal space and rotated for drawing water from the lower opening and for injecting the water from the lateral opening, the blockage preventing apparatus comprising:

a movable blade provided an inlet-side outer edge of the vane; and a fixed blade provided in the internal space of the casing member and arranged in the vicinity outside of a rotating locus of the movable blade.

The number of fixed blades may be one. In case of a large water jet propulsion unit, a plurality of fixed blades may be provided according to the number of vanes.

When the fixed blade is formed integrally with the vane, it is appropriate to select steel or stainless steel as material for the vane. In case of a large water jet propulsion unit, the movable blade formed separately may be attached to the vane in view of the need to replace blades due to abrasion and the like.

With the above constitution, the floating matter mixed in the water drawn into the casing member is sheared between the movable blades and the fixed blades, ensuring that the floating matter is driven out together with pressurized water. Thus, the floating matter is not deposited in the casing member to thereby prevent the water jet propulsion unit from being blocked.

The sixth aspect of the present invention is a blockage preventing apparatus according to the first or fifth aspect, wherein the vane is a helical vane including an outer peripheral edge portion adjacent to a peripheral surface of the internal space and an outer peripheral tip end portion extending toward an upstream side of a water flow.

With the above constitution, since the helical vanes each have an outer peripheral tip end portion extending toward the first internal space, it is possible to obtain a desired propulsion force even when the number of vanes is decreased. Due to this, a wide suction passage is provided, with the result that it becomes difficult for the floating matter in the drawn water to cling to the vanes and that the floating matter is easily discharged together with pressurized water.

BEST EMBODIMENT FOR CARRYING OUT THE INVENTION

Embodiments of the present invention will now be described in detail with reference to the accompanying drawings. In the description, forward means forward in navigation direction and backward means backward in navigation direction.

First Embodiment

Figure 1:
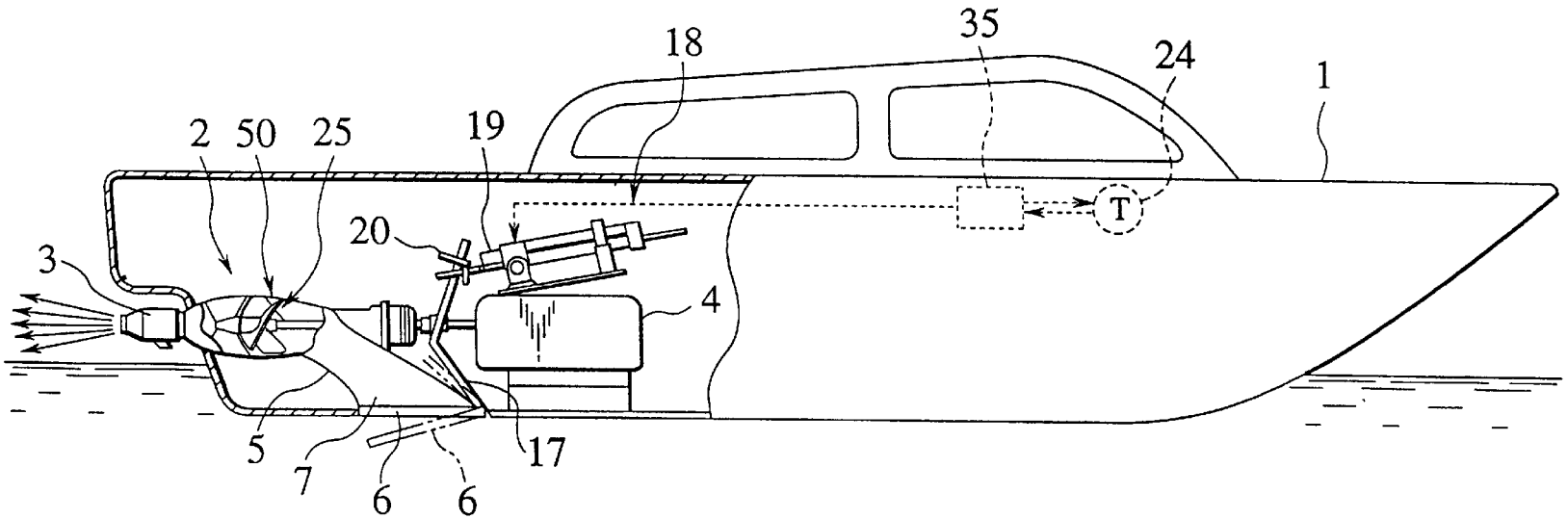
FIG. 1 is a schematic side view of a water jet propulsion unit in the first embodiment according to the present invention, showing that part of a hull on which a blockage preventing apparatus for the water jet propulsion unit is mounted is cut.

As shown in FIG. 1, a water jet propulsion unit 2 is mounted at the stern of a hull 1.

Figure 2:
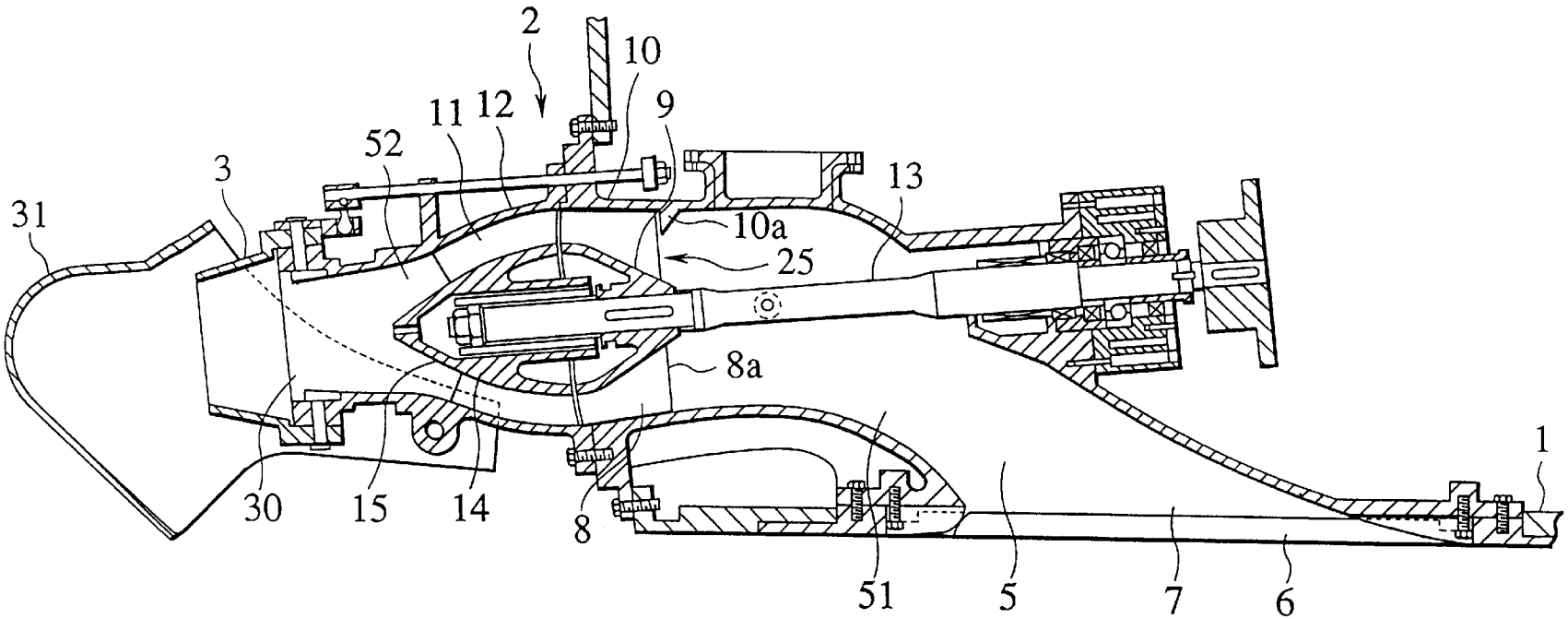
FIG. 2 is an enlarged view of important parts of the water jet propulsion unit shown in FIG. 1.

As shown in FIG. 2, the water jet propulsion unit 2 is provided with a casing member 50 and an impeller 25.

The casing member 50 consists of a suction casing 5, a pump casing 10 and an injection casing 12. A suction port 7 (opened downward) is provided on one end of the suction casing 5 and the pump casing 10 is provided integrally with the suction casing 5 on the other end thereof. The first internal space 51 extends diagonally away from the suction port 7 into pump casing 10. One end of the injection casing 12 is coupled to the pump casing 10 and an injection port 30 is provided on the other end of the injection casing 12. The second internal space 52 is provided within the casings 4 and 6 to transversely extend from the first internal space 51 toward the injection port 30. The impeller 25 is provided within the pump casing 10.

The water below the suction casing 3 is drawn from the suction port 7, passed through the first internal space 51, pressurized by the impeller 25 in the pump casing 10 and injected from the injection port 30 of the injection casing 12. The injection of the pressurized water propels the vessel 1.

A guide vane 11 is provided in the back of the impeller 25 within the second internal space 52 so that a turning flow pressurized by the impeller 25 is rectified into a linear flow. An injection nozzle 3 is provided outside the injection port 30 and a reverser 31 for backward motion is provided outside the injection nozzle 3.

As shown in FIG. 1, an engine 4 is mounted in front of the propulsion unit 2 of the hull 1. A drive shaft 13 is coupled to the engine 4. The drive shaft 13 is inserted into the suction casing 5 from the inclined shoulder portion of the suction casing 5 and extended toward the pump casing 10. The impeller 25 is concentrically fixed to the rear end of the drive shaft 13. Thus, the driving force of the engine 4 is inputted into the impeller 25 through the drive shaft 13.

Figure 3:
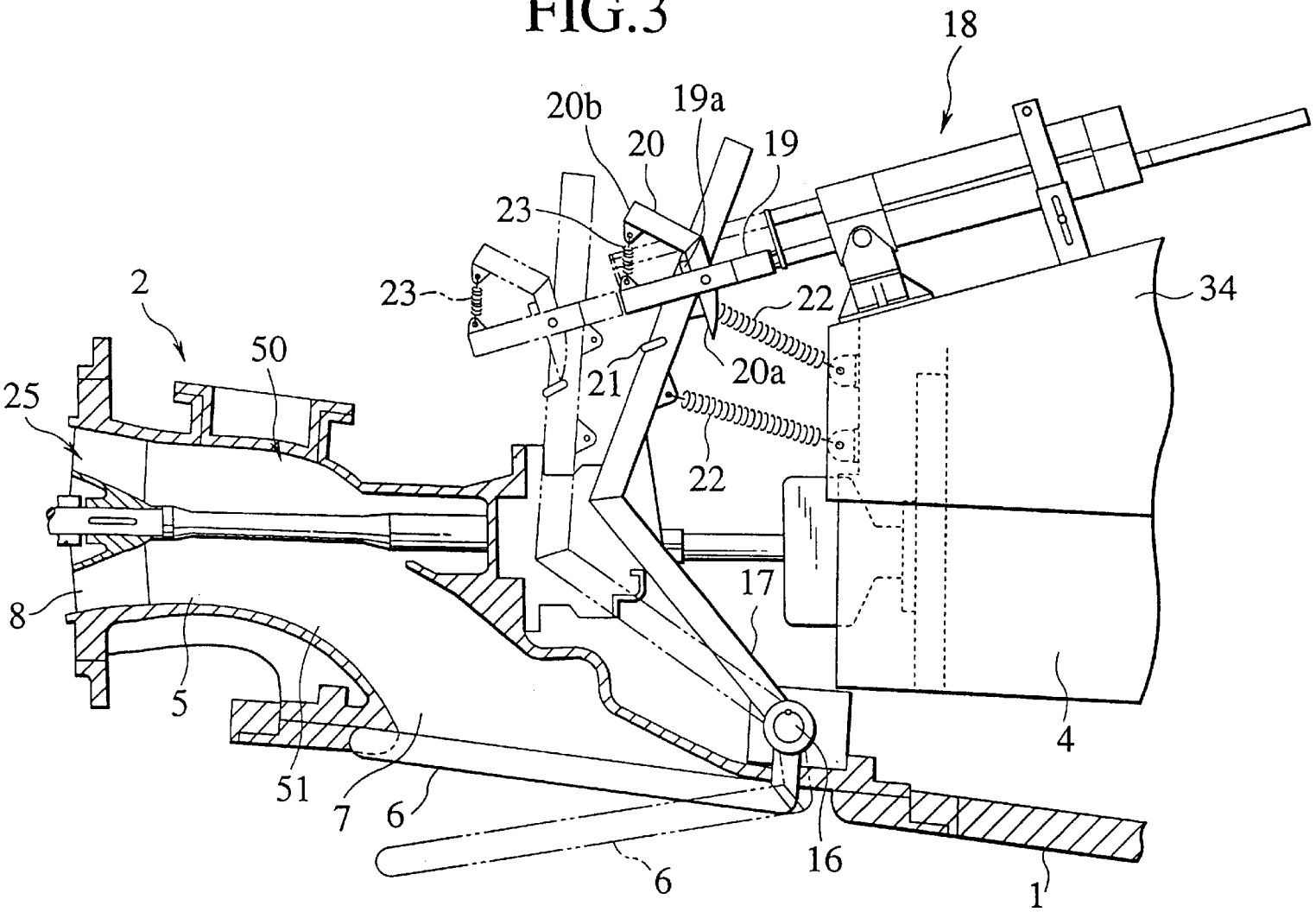
FIG. 3 is an enlarged view of important parts of the blockage preventing apparatus shown in FIG. 1.

As shown in FIG. 3, the suction port 7 of the suction casing 5 is provided with a screen 6 for preventing inflow of floating matter. The screen 6 is of comb or mesh shape. The front end of the screen 6 is coupled to a rotary shaft 16 rotatably supported by the suction casing 5 at the leading edge of the suction port 7. The screen 6 is rotatable about the rotary shaft 16 and moves between a closed position at which the suction port 7 is covered with the screen 6 and an open position shifted downward from the suction port 7. The base of an L-shaped working shaft 17 is fixed to the rotary shaft 16. The working shaft 17 rocks about the rotary shaft 16 following the opening/closing of the screen 6. The working shaft 17 is provided with an engagement protrusion (first engagement portion) 21. The engagement protrusion 21 protrudes in a direction crossing the rocking direction of the working shaft 17.

A frame 34 fixed to the hull 1 is arranged above the engine 4. A hydraulic cylinder (open/close driving machine) 18 is disposed on the frame 34. The hydraulic cylinder 18 has a piston 19 linearly movable forward and backward above the engagement protrusion 21 of the working shaft 17.

A hook 20 crossing the piston 19 is rotatably mounted at the piston 19. The hook 20 has an engagement end portion (second engagement portion) 20*a* protruding downward from the piston 19 and an upper end portion 20*b* protruding upward from the piston 19. The tip end of the piston 19 is coupled to the upper end portion 206 of the hook 20 by a spring 23. The spring 23 urges the engagement end portion 20*a* forward. The piston 19 has a protrusion 19*a* which abuts the hook 20 and prevents the forward movement of the engagement end portion 20*a*. The spring 23 and the protrusion 19*a* function to maintain the hook 20 to be positioned in an initial state in which the engagement end portion 20*a* extends almost at a right angle from the piston 19. When a forward pressing force is applied to the engagement end portion 20*a*, the protrusion 19*a* abuts the hook 20 to thereby prevent movement of the hook 20, thereby maintaining the hook 20 in the initial state. When a backward pressing force is applied to the engagement end portion 20*a*, the spring 23 extends to move the engagement end portion 20*a* backward. When the backward pressing force is canceled, the hook 20 returns to the initial state by the elastic force of the spring 23.

The working shaft 17 and the frame 34 are coupled to each other by two springs (urging members) 22. The springs 22 urge the working shaft 17 forward. The rear end of the screen 6 in a closed position abuts the leading edge of the suction port 7. The elastic force (urging force) of the springs 22 maintains the working shaft 17 and the screen 6 in the initial position and in the closed position, respectively. When a backward pressing force is applied to the engagement protrusion 21, the springs 22 extend and the working shaft 17 inclines and moves backward from the initial position. As a result, the engagement protrusion 21 moves backward and the screen 6 moves and opens. When the pressing force applied to the engagement protrusion 21 is canceled, the working shaft 17 and the screen 6 return to the initial position and the closed position, respectively by the elastic force of the springs 22.

As indicated by a solid line of FIG. 3, when the piston 19 is in a forefront position, the engagement end portion 20*a* is positioned forward with respect to the engagement protrusion 21 of the working shaft 17 in the initial position. When the piston 19 moves backward from the forefront position and the engagement end portion 20*a* reaches the first position, then the rear face of the engagement end portion 20*a* contacts with the engagement protrusion 21 from forward. The movement region of the engagement end portion 20*a* from the first position to the backward is a linear band shape along the movement line of the piston 19. The movement region of the engagement protrusion 21 when the working shaft 17 moves backward from the initial position, is a curved band shape along a radii about the rotary shaft 16. The movement region of the engagement end portion 20*a* and that of the engagement protrusion 21 are set such that the movement region of the engagement end portion 20*a* from the first position to the second position in the back of the first position overlaps that of the engagement protrusion 21 and that the backward movement region of the engagement end portion 20*a* with respect to the second position is shifted from the movement region of the engagement protrusion 21. Therefore, when the piston moves backward and the engagement end portion 20*a* moves through the first position to the second position, the engagement end portion 20*a* is engaged with and presses the front face of the engagement protrusion 21 and the screen 6 moves from the closed position to the open position against the elastic force of the springs 22. The moment the engagement end portion 20*a* exceeds the second position, the engagement protrusion 21 is completely shifted from the engagement end portion 20*a* downward and the screen 6 is returned to the closed position by the springs 22. In this state, when the piston 19 moves forward and the engagement end portion 20*a* moves toward the first position, the engagement end portion 20*a* abuts the engagement protrusion 21 and is pressed backward and the hook 20 inclines and moves. When the engagement end portion 20*a* goes over the first position, the engagement end portion 20*a* moves beyond the engagement protrusion 21 and the hook 20 returns to the initial state. Every time the piston 19 reciprocates once, the screen 6 opens and closes the suction port 7 once. The screen 6 opens the intake port 7 at a slow rate and closes it at a rapid rate.

As shown in FIG. 1, the hull 1 is provided with a timer 24 and a control circuit 35 which constitute control means. The timer 24 sets time freely in accordance with the state of the water surface on which the hull 1 sails. For instance, when the water surface has much floating matter, the time is set at 10 seconds, and when there is less floating matter, the time is set at 120 seconds. The timer 24 outputs a signal to the control circuit 35 at set time intervals.

Figure 4:
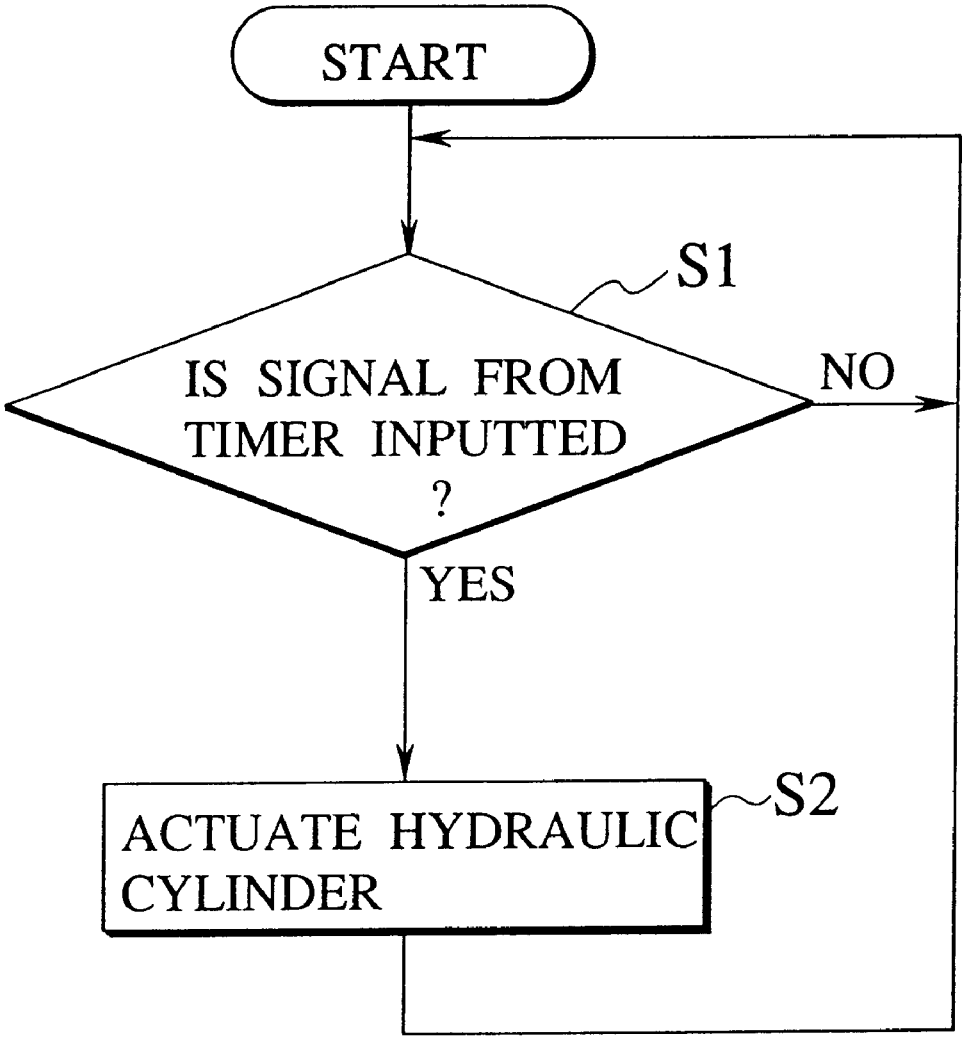
FIG. 4 is a flow chart showing opening/closing control in the first embodiment.

As shown in the flow chart of FIG. 4, when the control circuit 35 is turned on, it is determined whether the control circuit 35 inputs a signal from the timer 24 after the timer 24 is turned on (in a step S1). When it is confirmed that the signal from the timer 24 is inputted to the control circuit 35, a drive signal is outputted to the hydraulic cylinder 18 and the cylinder 18 is actuated (in a step S2). By doing so, when the piston 19 reciprocates once, the screen 6 opens and closes once. Back in the step S1, the series of steps stated above are repeated. The screen 6 is, thereby, opened and closed at set time intervals.

It is also possible to separately provide a manual switch (not shown) for outputting a drive signal to the hydraulic cylinder 18 and to operate the manual switch regardless of ON/OFF controlling of the control circuit 35, to thereby appropriately freely open and close the screen 6.

Figure 5:
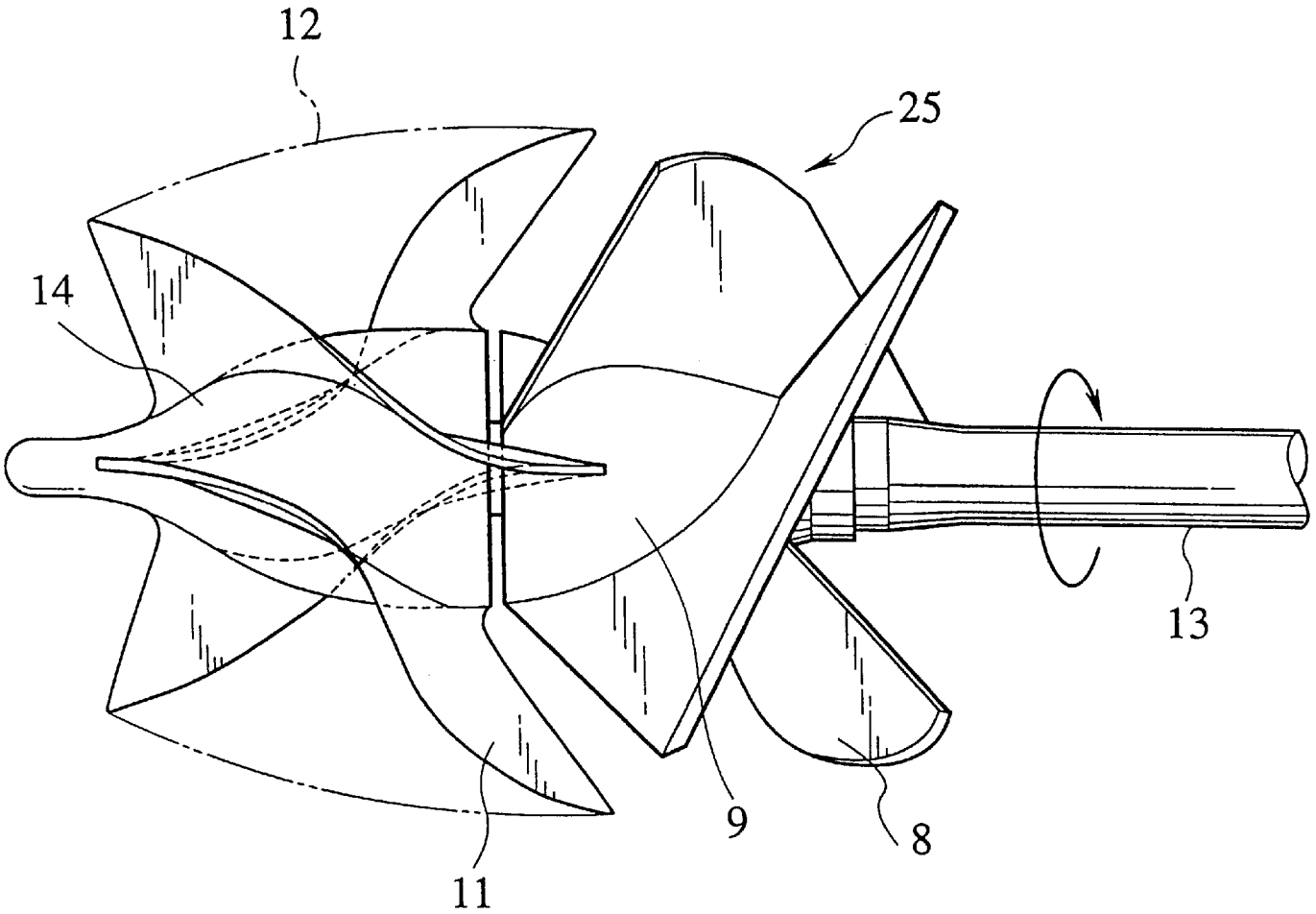
FIG. 5 a perspective view showing vanes shown in FIG. 1.
Figure 6:
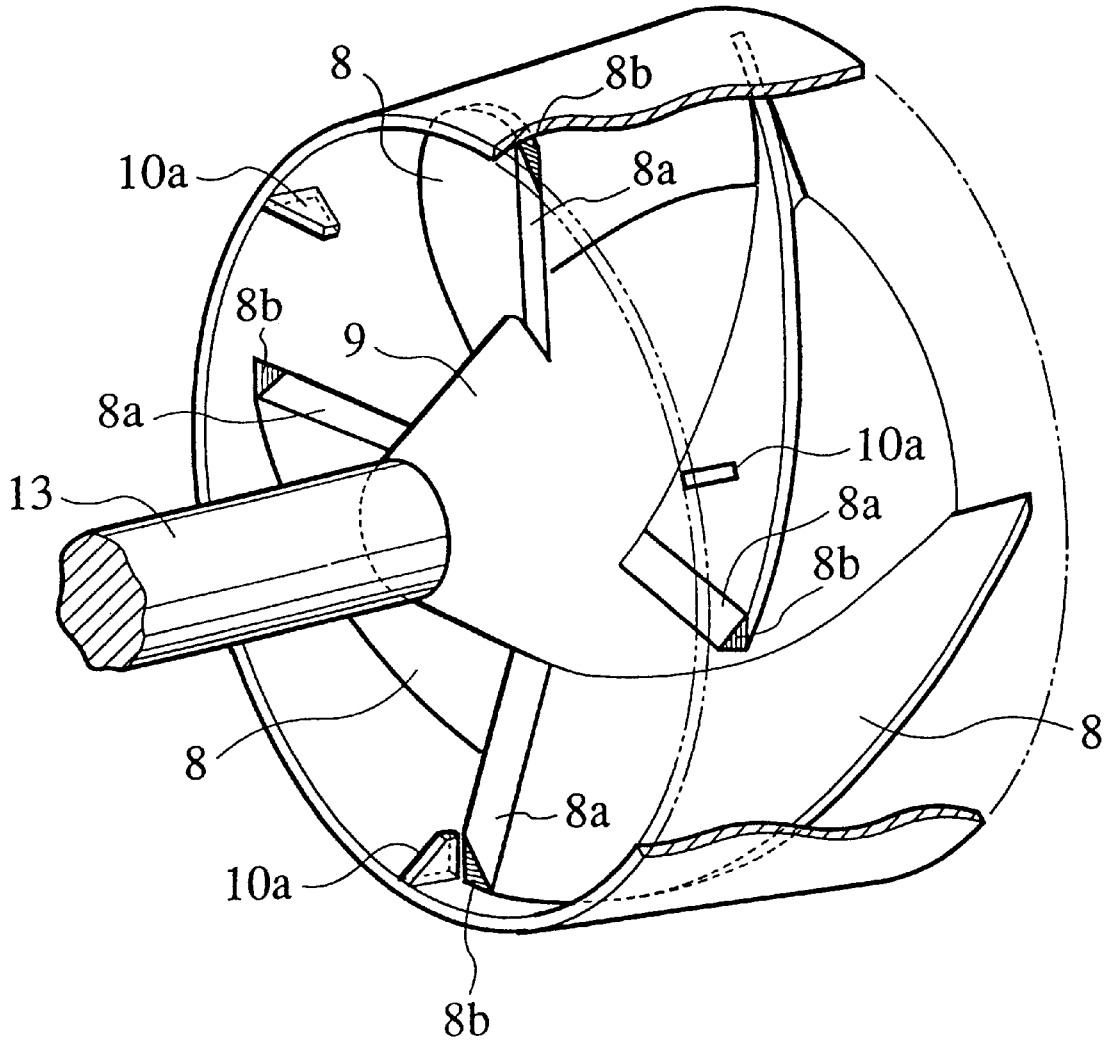
FIG. 6 is a perspective view of movable blades and fixed blades.

As shown in FIGS. 2, 5 and 6, the impeller 25 includes a hub 9 fixed to the outer periphery of the drive shaft 13 and four vanes 8 protruding from the hub 9. Each of the vane 8 is helical and made of steel or stainless steel. The proximal portions of the vanes 8 are attached to the hub 9 with their phases shifted from one another. The outer peripheral edge of the vane 8 is arranged to be adjacent to inner peripheral surface of the pump casing 10 so as to improve the volumetric efficiency and balancing efficiency of the impeller 25. The outer peripheral tip end portion of the vane 8 in the forward direction (intake water inflow side) extends in the (forward) direction of the suction casing 5. By using the helical vanes, it is possible to obtain a desired propulsion force with a small number of vanes 8. This allows for a wide suction passage, with the result that floating matter which has been drawn in is less entwined around the vanes 8 and can be easily discharged together with pressurized water.

As shown in FIGS. 2 and 5, a guide vane 11 protrudes from the central base 14. The inlet side edge of the guide vane 11 is adjacent to the outlet side edge of the vane 8. The outer peripheral edge of the guide vane 11 is fixed to the inner surface of the injection casing 12. A bearing 15 is fitted into the center of the central base 14. The tip end of the drive shaft 13 is rotatably supported by the bearing 15.

As shown in FIG. 6, a sharp blade 8*a* is integrally formed with each vane 8 at the tip end portion of the suction water inflow-side vane 8. When the vane 8 rotates, the blade 8*a* crosses water flow. A movable blade 8*b* is formed integrally with the outer edge of the blade 8*a*. Fixed blades 10*a* protruding into the flow passage of the suction water at three positions on the inner peripheral surface of the suction water inflow-side pump casing 10. The fixed blades 10*a* are arranged in the vicinity of the outside of the rotating locus of the movable blade 8*b*. The fixed blade 10*a* and the movable blade 8*b* passing above the blade 10*a* function as a pair of cutting mechanisms. Among particles mixed in the suction water from the suction port 7, those at the central portion are cut and crushed by the rotating blades 8*a* and those at the outer peripheral edge are cut and crushed by the movable blades 8*b* and the fixed blades 10*a*.

The number of vanes 8 and that of the fixed blades 10*a* are not limited to the above example. Also, in the above embodiment, the blade 8*a* is formed integrally with the vane 8. In view of abrasion and the like, the blade portion 8*a* of steel or stainless steel formed independently of the vane 8 may be detachably attached to the vane 8.

In the first embodiment, in a case where the vessel sails in a location where much floating matter exists, the open/close control circuit 35 is turned on. By doing so, the screen 6 opens and closes the suction port 7 at set time intervals. The screen 6 opens the suction port 7 slowly and then moves quickly to the closed position. Therefore, while the screen 6 slowly moves to the open position, the floating matter, such as dust, clinging to the screen 6 is driven out by water flow to thereby clean the screen 6. Since the screen 6 quickly returns from the open position to the closed position, it is difficult for floating matter to flow into the suction port 7 while the screen 6 is moving to the open position. In addition, appropriate vibration and impact are applied to the screen 6 by the quick return of the screen 6 from the closed position to the open position. Thus, the effect of brushing off the floating matter clinging to the screen 6 increases, thereby cleaning the screen 6 more effectively. It is, therefore, possible to ensure removing the floating matter strongly clinging to the screen 6.

Furthermore, since the screen 6 is opened and closed at preset time intervals, the screen 6 is cleaned before the quantity of floating matter clinging to the screen 6 becomes excessive. This facilitates peeling off the floating matter from the screen 6 and the efficiency of cleaning the screen 6 enhances.

Moreover, the floating matter mixed in the water drawn into the casing member 50 is not only cut by the blade portions 8*a* but also sheared between the movable blades 8*b* and the fixed blades 10*a*, ensuring that the floating matter is driven out together with pressurized water. Thus, floating matter is not deposited in the casing member 50 to thereby prevent the water jet propulsion unit 2 from being blocked.

Additionally, by employing the helical vanes where each vane has an outer peripheral tip end portion extending toward the first internal space 51, it is possible to obtain a desired propulsion force even when the number of vanes 8 is decreased. Due to this, a wide suction passage is provided, with the result that it becomes difficult for the floating matter in the drawn water to cling to the vanes 8 and that the floating matter is easily discharged together with pressurized water.

Second Embodiment

Figure 7:
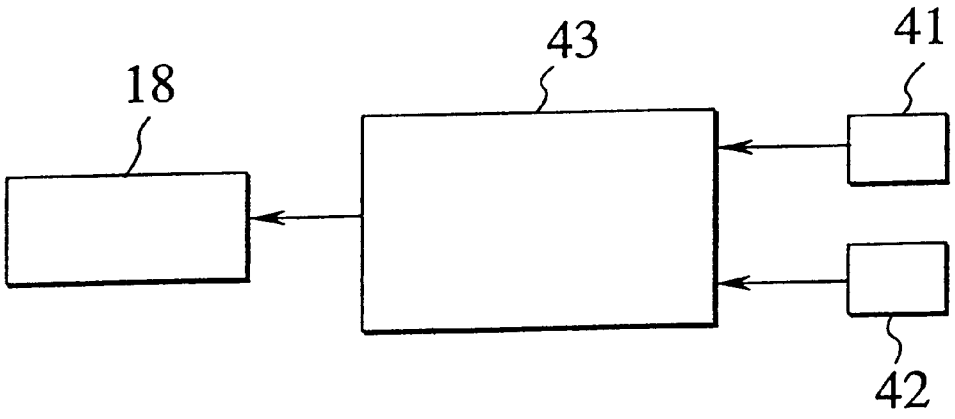
FIG. 7 is a block diagram showing important parts of the second embodiment according to the present invention.

As shown in FIG. 7, in a second embodiment, the timer 24 and the control circuit 35 used in the first embodiment are replaced by a rotating speed sensor (rotating speed detecting means) 41, a hull speed sensor (hull speed detecting means) 42 and a control circuit (control means) 43. The remaining constituent elements are the same as those in the first embodiment, which description will not be, therefore, given herein.

The rotating speed sensor 41 detects the rotating speed of the drive shaft (shown in FIG. 2) 13 (rotating speed of the vane 8) and sequentially outputs a detection signal to the control circuit 43. The hull speed sensor 42, which is arranged at the bottom of the hull 1 (shown in FIG. 1), detects a hull speed and sequentially outputs a detection signal to the control circuit 43.

The control circuit 43 estimates the design speed of the hull 1 corresponding to the detected rotating speed of the vane 8. The design speed of the hull 1 indicates hull speed at a time no floating matter clings to the screen 6 (shown in FIG. 1). By way of example, the design speed is estimated as follows. The relationship between the rotating speed of the vane 8 and the hull speed in a state in which no floating matter clings to the screen 6 is obtained through experiment in advance and stored in an internal memory. The design speed is then obtained from the relationship and a detected rotating speed. Next, a reduction rate of the hull speed with respect to the design speed is calculated. Finally, when the calculated reduction rate is not more than a predetermined value, an actuating signal is outputted to the hydraulic cylinder 18 (shown in FIG. 1).

In the second embodiment, when the quantity of floating matter clinging to the screen 6 increases and the hull speed is reduced, then the hydraulic cylinder 18 is actuated in accordance with the reduction rate. It is, therefore, possible to clean the screen 6 before the quantity of floating matter clinging to the screen 6 becomes excessive. This facilitates removing the floating matter from the screen 6 and thereby enhances the cleaning of the screen 6.

Third Embodiment

Figure 8:
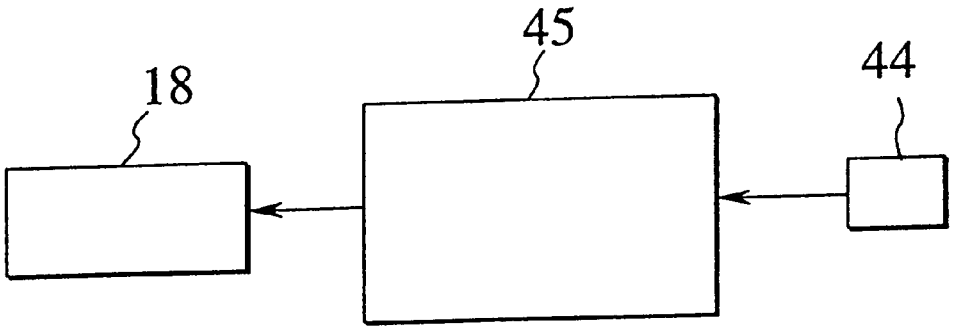
FIG. 8 is a block diagram showing important parts of the third embodiment according to the present invention.

As shown in FIG. 8, in a third embodiment, the timer 24 and the control circuit 35 used in the first embodiment are replaced by a pressure sensor (pressure detecting means) 44 and a control circuit (control means) 45. It is noted that the remaining constituent elements are the same as those in the first embodiment, which description will not be, therefore, given herein.

The pressure sensor 44, which is provided in the suction casing 5 (shown in FIG. 2), detects an internal pressure of the suction casing 5 upstream of the vanes 8 and sequentially outputs a detection signal to the control circuit 45.

The control circuit 45 determines whether or not the detected internal pressure is less than a preset reference value (e.g., one atmosphere pressure). When it is less than the reference value, the control circuit 45 outputs an actuating signal to the hydraulic cylinder 18 (shown in FIG. 1).

In the third embodiment, when the quantity of floating matter clinging to the screen 6 increases and the internal pressure of the suction casing 5 decreases, the hydraulic cylinder 18 is actuated in accordance with the reduction of the pressure. It is, therefore, possible to clean the screen 6 before the quantity of floating matter clinging to the screen 6 becomes excessive. This facilitates removing the floating matter from the screen 6 and enhances cleaning of the screen 6.

INDUSTRIAL APPLICABILITY

As stated above, according to the present invention, while the screen slowly moves to the open position, the floating matter clinging to the screen is securely driven out by water flow and the screen is cleaned. Additionally, since the screen quickly returns from the open position to the closed position, it is made difficult for floating matter to flow into the lower opening while the screen is moving to the closed position. Besides, appropriate vibration and impact are applied to the screen by the quick return of the screen from the open position to the closed position. Due to this, the effect of brushing off the floating matter clinging to the screen is enhanced, thereby removing the floating matter strongly clinging to the screen. Hence, the present invention is useful as a blockage preventing apparatus for a water jet propulsion unit.

What is claimed is:

1. A blockage preventing apparatus for a water jet propulsion unit with a lower opening comprising:

a screen rotatably supported with respect to a front end of said lower opening and moving between a closed position at which the screen covers said lower opening and an open position shifted downward from said lower opening;

an urging member urging said screen to said closed position;

a first engagement portion moving together with said screen; and a second engagement portion moving from a first position beyond a second position, wherein when said second engagement portion moves from said first position to said second position, said second engagement portion is engaged with and presses said first engagement portion to move said screen from said closed position to said open position, and when said second engagement portion moves beyond said second position, said first engagement portion is disengaged from said second engagement portion and said screen is returned from said open position to said closed position by said urging member.

2. A blockage preventing apparatus according to claim 1, further comprising an open/close driving machine for moving said second engagement portion, wherein said second engagement portion is set such that a movement region of said second engagement portion from said first position to said second position overlaps a movement region of said first engagement portion and a movement region of said second engagement portion beyond said second position is out of the movement region of said first engagement portion.

3. A blockage preventing apparatus according to claim 2, wherein said open/close driving machine includes a piston moved forward and backward by oil pressure; and said second engagement portion is provided at said piston.

4. A blockage preventing apparatus according to claim 2, further comprising open/close controlling means for intermittently actuating said open/close driving machine at predetermined time intervals.

5. A water jet propulsion unit comprising:

a casing member including a lower opening at a front end, a lateral opening at a rear end and an internal space between said lower opening and said lateral opening;

a vane arranged within said internal space and rotated for drawing water from said lower opening to inject the water from said lateral opening;

a screen rotatably supported with respect to a front end of said lower opening and moving between a closed position at which the screen covers said lower opening and an open position shifted downward from said lower opening;

an urging member urging said screen to said closed position;

a first engagement portion moving together with said screen; and a second engagement portion moving from a first position beyond a second position, wherein when said second engagement portion moves from said first position to said second position, said second engagement portion is engaged with and presses said first engagement portion to move said screen from said closed position to said open position, and when said second engagement portion moves beyond said second position, said first engagement position is disengaged from said second engagement portion and said screen is returned from said open position to said closed position by said urging member.

6. A water jet propulsion unit according to claim 5, further comprising an open/close driving machine for moving said second engagement portion, wherein said second engagement portion is set such that a movement that a movement region of said second engagement portion from said first position to said second position overlaps a movement region of said first engagement portion and a movement region of said second engagement portion beyond said second position is out of the movement region of said first engagement portion.

7. A water jet propulsion unit according to claim 6, wherein said open/close driving machine includes a piston moved forward and backward by oil pressure; and said second engagement portion is provided at said piston.

8. A water jet propulsion unit according to claim 6, further comprising open/close controlling means for intermittently actuating said open/close driving machine at predetermined time intervals.

9. A water jet propulsion unit according to claim 6, further comprising:

rotating speed detecting means for detecting a rotating speed of said vane;

hull speed detecting means for detecting a speed of a hull;

control means for estimating a design speed of the hull corresponding to the detected rotating speed of said vane and for actuating said open/close driving machine in accordance with a reduction rate of said hull speed with respect to said design speed.

10. A water jet propulsion unit according to claim 6, further comprising:

pressure detecting means for detecting an internal pressure of an internal space of said casing member; and control means for actuating said open/close driving machine in accordance with a reduction in said internal pressure.

11. A water jet propulsion unit according to claim 5, further comprising:

a movable blade provided on an inlet-side outer edge of said vane; and a fixed blade provided in said internal space of said casing member and arranged in the vicinity outside of a rotating locus of said movable blade.

12. A water jet propulsion unit according to claim 5, wherein said vane is a helical vane including an outer peripheral edge portion adjacent to a peripheral surface of said internal space and an outer peripheral tip end portion extending toward an upstream side of a water flow.

13. A water jet propulsion unit according to claim 11, wherein said moving blade is made of one of steel and stainless steel.

14. A water jet propulsion unit according to claim 11, wherein said movable blade is provided separately from said vane.

* * * * *